US006502922B2

(12) United States Patent
Kawase et al.

(10) Patent No.: US 6,502,922 B2
(45) Date of Patent: Jan. 7, 2003

(54) MOVING UP AND DOWN APPARATUS OF PRINT HEAD, PRINTING APPARATUS

(75) Inventors: Junya Kawase, Kanagawa (JP); Tsutomu Kawai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/822,172

(22) Filed: Apr. 2, 2001

(65) Prior Publication Data

US 2001/0038401 A1 Nov. 8, 2001

(30) Foreign Application Priority Data

Apr. 4, 2000 (JP) ..... 2000-102734
Feb. 6, 2001 (JP) ..... 2001-030166

(51) Int. Cl.[7] ..... B41J 2/155
(52) U.S. Cl. ..... 347/42
(58) Field of Search ..... 347/104, 105, 347/42, 8, 32; 346/139 D

(56) References Cited

U.S. PATENT DOCUMENTS 5,057,852 A * 10/1991 Formica et al. ..... 347/43
5,372,936 A 12/1994 Kawai et al. ..... 206/204
5,793,392 A * 8/1998 Tschida ..... 347/40
6,092,891 A * 7/2000 Okubo et al. ..... 347/104

FOREIGN PATENT DOCUMENTS

EP 0 884 196 A2 12/1998
JP 06 171180 A 6/1994
JP 06 253119 9/1994
JP 07 047670 2/1995
JP 07 276618 10/1995
JP 09 123470 A 5/1997

* cited by examiner

*Primary Examiner*—Thinh Nguyen
(74) *Attorney, Agent, or Firm*—Fitzpatrick, Cella, Harper & Scinto

(57) ABSTRACT

Spring members urge a print head support member with an urging force greater than a predetermined value so as to decrease a backlash.

19 Claims, 12 Drawing Sheets

MOVING UP AND DOWN APPARATUS OF PRINT HEAD, PRINTING APPARATUS

BACKGROUND OF THE INVENTION

This application is based on Japanese Patent Application Nos. 2000-102734 filed Apr. 4, 2000 and 2001-030166 filed Feb. 6, 2001, the content of which is incorporated hereinto by reference.

1. Field of the Invention

The present invention relates to a moving up and down apparatus of a print head for vertically moving the print head, and to a printing apparatus incorporating same.

2. Description of Prior Art

An ink-jet printing apparatus, in general, may be provided with a moving up and down apparatus for moving up and down a print head provided in the printing system thereof relative to a recording surface of a printing medium or to a capping member or the like of a recovery processing unit for performing recovery processing of print head is used in practical application.

Such a moving up and down apparatus, for example, comprises a print head support member for supporting the print head for ejecting an ink onto the recording surface of the printing medium for performing printing operation, a drive mechanism for vertically moving the support member relative to the recording surface of the printing medium or the capping member or the like of the recovery processing unit, and a drive motor.

The drive mechanism is to move up and down the print head support member relative to the recording surface of the printing medium or the capping member or the like of the recovery processing unit according to a drive force from the drive motor transmitted through a speed reducer having a predetermined reduction ratio. The drive mechanism moves up and down the print head support member, for example, by a screw movement.

For example, when the print head is a so-called continuous length type having a relatively large number of ink ejection openings, since a total weight of the above print head support member and the print head is relatively large, when a drive motor of relatively low power is used, it is necessary to set the reduction ratio of the speed reducer to a relatively large value. However, when the reduction ratio of the speed reducer is set to a relatively large value, since the vertical moving speed of the print head support member is decreased, there is a limit in utilizing a drive motor of relatively low power.

Further, in the above drive mechanism, because there is play, that is, a backlash, between mechanical elements, for example, between a screw shaft and a screw hole for performing screw movement, when the capping and blade and the like of the recovery processing unit come in contact with the ink ejection part of the print head at a predetermined pressure, the print head support member and the print head are pressed and moved by a moving distance corresponding to the backlash, therefore, there is a fear that capping and wiping will not be performed sufficiently accurately.

In view of the above problems, an object of the present invention is to provide a moving up and down apparatus of a print head, and printing apparatus capable of removing a backlash between component elements of the moving up and down mechanism, removing a backlash between component elements of the moving up and down mechanism by a constant urging force, and capable of providing a downsizing of the drive motor.

SUMMARY OF THE INVENTION

In accordance with the present invention which attains the above object, there is provided a moving up and down apparatus of a print head comprising a print head support part for supporting the print head which performs an ejection of a liquid in order to perform a printing operation of printing on a recording surface of a printing medium, a drive force transmitted part provided in the print head support part to receive and transmit a drive force for reciprocally moving the print head support part, a drive force transmission part engaged with the drive force transmitted part through a gear teeth part for transmitting the drive force to the drive force transmitted part, a drive force supply part connected to the drive force transmission part for supplying the drive force to the drive force transmission part, and an urging member for urging the print head support part in a predetermined direction.

Further, the moving up and down apparatus of print head according to the present invention comprises a print head support part for supporting a print head for performing a printing operation of printing on a recording surface of a printing medium, a screw shaft member provided on said print head support part in which a first screw part is formed along a moving direction of the print head support part, a drive force transmission member provided in the print head support part having a first screw part formed along a moving direction of the print head support part and a second screw part engaged. with the first screw part of the screw shaft member for transmitting a supplied drive force to the screw shaft, a drive force supply part connected to the drive force transmission member for supplying a drive force, and an urging member for directly or indirectly urging the screw shaft member or the drive force transmission member in a direction.

Yet further, the printing apparatus according to the present invention comprises a print head for ejecting a liquid in order to perform a printing operation of printing on a recording surface of a printing medium, a print head support part for supporting the print head, a drive force transmitted part provided in the print head support part to receive and transmit a drive force for reciprocally moving the print head support part by a predetermined distance, a drive force transmission part engaged with the drive force transmitted part through a gear teeth part for transmitting the supplied drive force, a drive force supply part connected to the drive force transmission part for supplying a drive force, and an urging member for urging the print head support part in a predetermined direction.

As can be seen from the above description, with the moving up and down apparatus of the print head, and the printing apparatus, according to the present invention, since the urging member urges the print head support part in a predetermined direction, backlash between component elements of the vertical moving mechanism can be removed, and the drive motor be downsized.

Further, since the urging member urges the screw shaft member or the drive force transmission member in a predetermined direction, directly or indirectly, backlash between component elements of the vertical moving mechanism can be removed by a constant urging force irrespective of the vertical moving position of the print head.

The above and other objects, features and advantages of the present invention will become more apparent from the following description of embodiments thereof taken in conjunction with the accompanying drawings.

DESCRIPTION OF PREFERRED EMBODIMENTS

Figure 2:
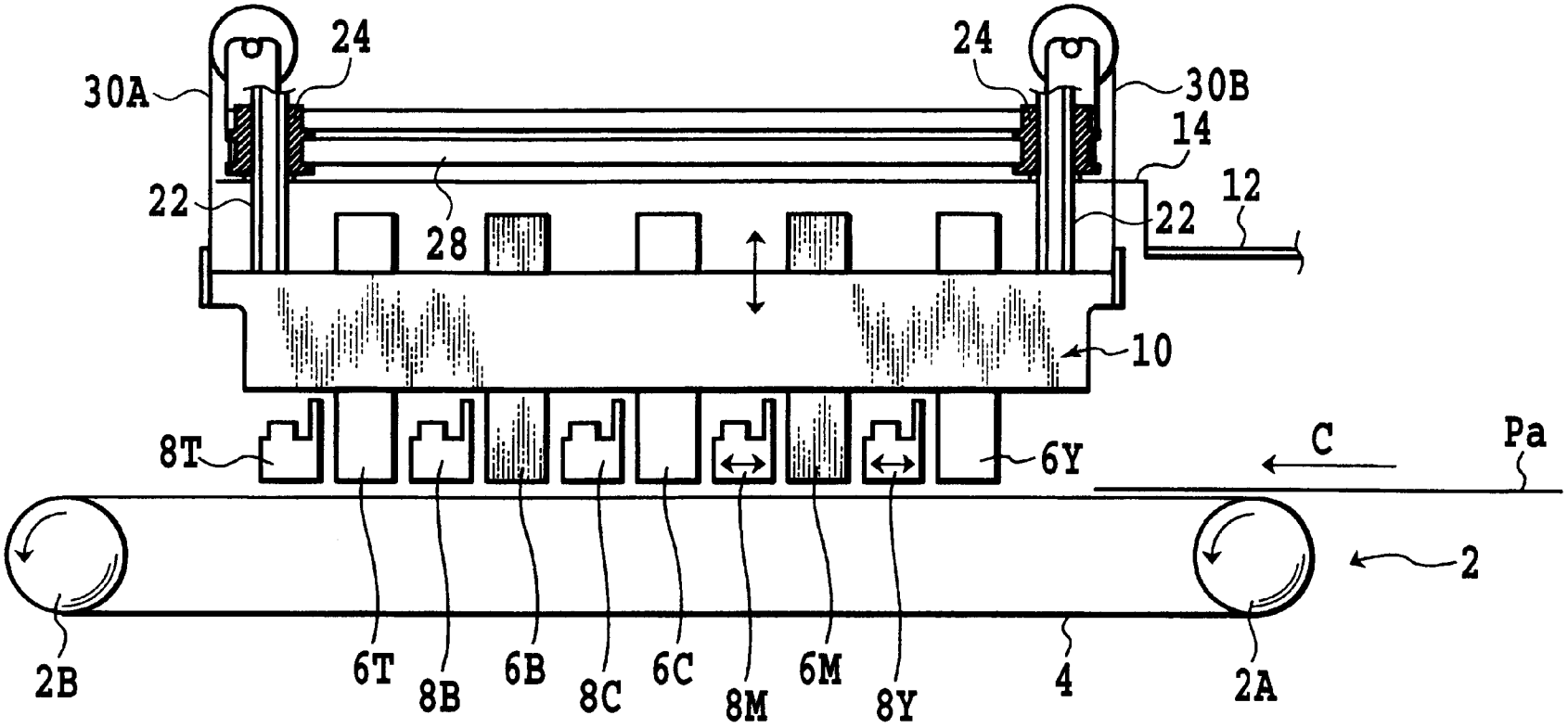
FIG. 2 is a diagram schematically showing the first embodiment of the moving up and down apparatus of print head according to the present invention, along with an ink-jet printing apparatus to which the invention is applied.

FIG. 2 shows a brief construction of an important point of the first embodiment of the moving up and down apparatus of the print head according to the present invention, along with the construction of an ink-jet printing apparatus to which the invention is applied.

In FIG. 2, the ink-jet printing apparatus comprises a transportation part 2 for transporting paper Pa as a printing medium according to the printing operation of print heads 6Y to 6T which will be described later, a recovery processing unit 8 disposed above the transportation part 2 for performing recovery processing of the print heads 6Y to 6T, print heads 6Y to 6T for performing printing operation to the recording surface of paper Pa, and a moving up and down apparatus 10 for bringing the print heads 6Y to 6T close to the recording surface of paper Pa in printing positions or away from the transportation part 2 to take a stand-by position. FIG. 2 shows a state where the print heads 6Y to 6T are disposed in printing positions.

The transportation part 2 comprises transportation rollers 2A and 2B disposed in opposition to each other at an upstream side and downstream side formed along the direction shown by arrow C in FIG. 2 beneath the moving up and down apparatus 10 and the print heads 6Y to 6T, a transportation belt 4 wound round the transportation rollers 2A and 2B, and a drive motor (not shown) connected to an end of the transportation roller 2B for rotating with the transportation roller 2A through the transportation belt 4.

Figure 1:
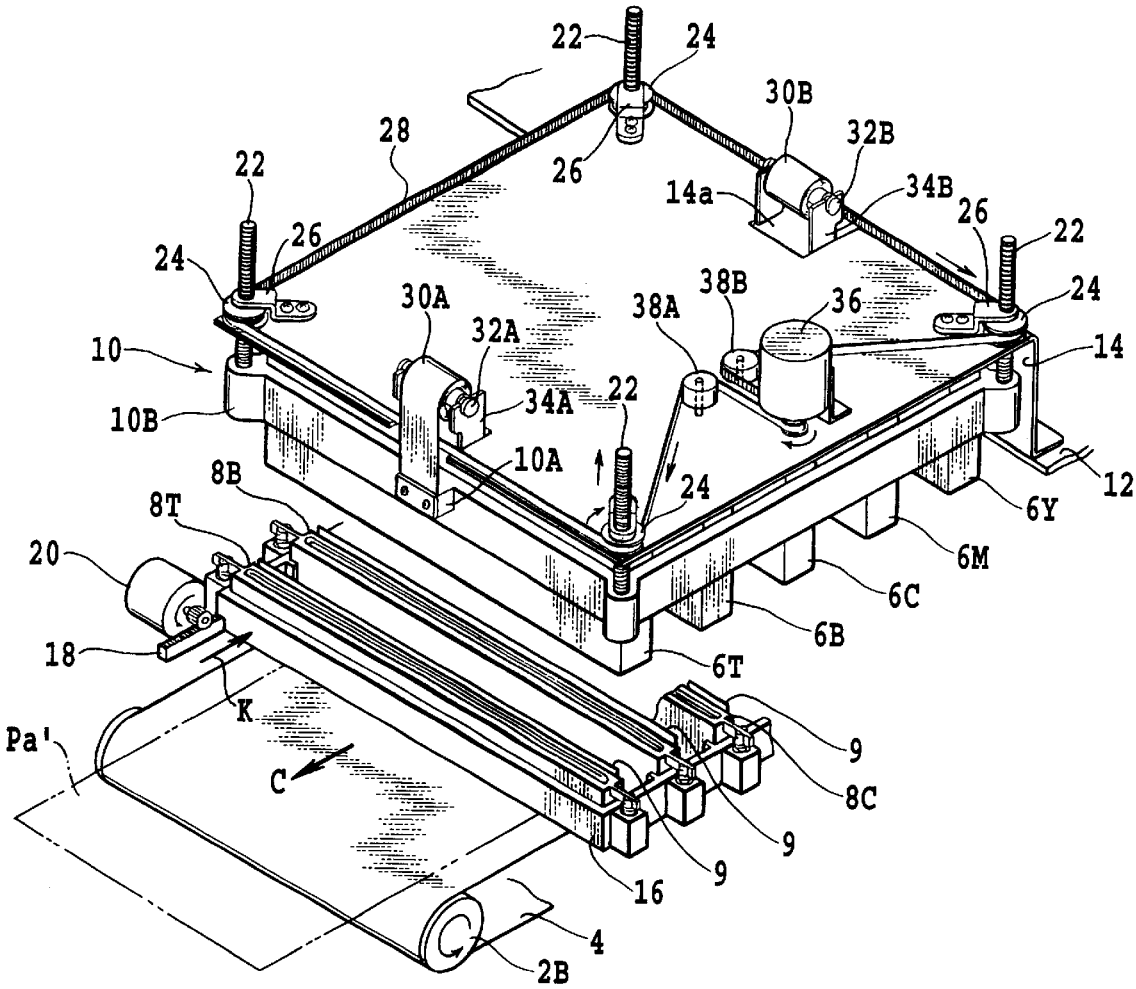
FIG. 1 is a perspective diagram showing a first embodiment of the moving up and down apparatus of print head according to the present invention, along with an ink-jet printing apparatus to which the invention is applied.

Lengths of axial direction of the transportation rollers 2A and 2B, and width of the transportation belt 4 are, as shown in FIG. 1, set longer than a width of a predetermined paper Pa, and length of the transportation belt 4 along the transportation path is set longer than the length of arrangement direction of the print heads 6Y to 6T.

The transportation belt 4 is generated with a predetermined charge on the surface thereof by an electrostatic induction action of a static electrification device disposed at the upstream side of the transportation path (not shown), thereby holding to transport paper Pa by its attracting force.

The drive motor is controlled according to a drive control signal from a controller (not shown). Accordingly, the transportation belt 4 transports intermittently paper Pa placed thereon according to the printing operation of the print heads 6Y to 6T.

The recovery processing unit 8, as shown in FIG. 1 and FIG. 2, comprises capping members 8Y, 8M, 8C, 8B and 8T provided correspondingly to respective print heads 6Y, 6M, 6C, 6B and 6T which will be described later, and a plurality of blade members 9 provided adjacent to the respective capping members 8Y to 8T.

Since the capping members 8Y, 8M, 8C, 8B and 8T have the same structures each other, only the capping member 8T will be described, and description of other capping members 8Y to 8B is omitted.

The capping member 8T has an opening end at the upper side, when the print head 6T takes the predetermined stand-by position away from the transportation path, is moved in a direction shown by arrow K in FIG. 1, so that its tip surface closely contacts with the entire ink ejection opening formation surface which is moved down. Further, the inside of the capping member 8T has a liquid absorber which once absorbs and holds a treatment liquid ejected from the print head 6T. The liquid absorbed by the liquid absorber is recovered into a waste liquid tank (not shown) through a waste liquid tube connected with that.

The capping member 8T is provided with a thin-plate formed blade member 9 nearly parallel and adjacent to the capping member 8T. The blade member 9, when the print head 6T takes a predetermined stand-by position, is moved to a direction opposite to that shown by arrow K of FIG. 1, so as to wipe off an ink or the like adhered to the ink ejection opening formation surface of the proximal print head 6T.

The respective capping members 8Y to 8B, as shown in FIG. 1, are connected by fixing in parallel to each other in a unit base 16 with predetermined intervals in a direction almost perpendicular to the transportation direction of paper Pa. The unit base 16 is supported by a guide member (not shown) to be capable of reciprocally moving by a predetermined distance along the transportation direction of paper Pa. The unit base 16 has spaces between the respective capping members 8Y to 8B so that the ink ejection openings of the respective print heads 6Y to 6T are possible to go in. At one end of the unit base 16, as shown in FIG. 1, a rack member 18 is provided. The rack member 18 is engaged with a pinion gear fixed to an output shaft of a drive motor 20 provided in a part opposing an end of the capping member 8T of the enclosure.

The drive motor 20 is controlled according to a drive control pulse signal from a controller (not shown).

Therefore, when the print heads 6Y to 6T take predetermined stand-by positions, and the drive motor 20 is made operative to be rotated in one direction by a predetermined rotation angle, as shown in FIG. 1, the unit base 16 is moved in a direction shown by arrow K so that the respective capping members 8Y to 8T are moved to a position just beneath the respective print heads 6Y to 6T. Then, the respective print heads 6Y to 6T are moved down, so that a predetermined recovery processing, for example, suction or preliminary ejection operation of the respective print heads 6Y to 6T is performed to the respective print heads 6Y to 6T. As a result, clogging or the like of the ink ejection opening is eliminated.

On the other hand, when the print heads 6Y to 6T take predetermined stand-by positions, and the drive motor 20 is made operative to be rotated, in the other direction by a predetermined rotation angle, as shown in FIG. 1, the unit base 16 is moved in a direction opposite to the direction shown by arrow K. By this operation, as shown in FIG. 2, the respective capping members 8Y to 8T are moved to the extremity of the downstream end side, or between the respective print heads 6Y to 6T, and a wiping operation is performed by the blade member 9 to the ink ejection opening formation surface.

The print heads 6Y to 6B are successively arranged from the upstream side to the downstream side of the transportation path, which respectively eject yellow, magenta, cyan and black inks. The print head 6T ejects a treatment liquid for insolubilizing each ink adhered to the recording surface of paper Pa. The respective inks and treatment liquid are successively supplied from ink tanks and a treatment liquid tank (not shown).

The print heads 6Y to 6T are respectively of a bubble jet type, and comprise printing element board 92 have an ink ejection opening formation surface having a plurality of ink ejection openings 96 formed on a part opposing the recording surface of the transported paper Pa, as described later. The plurality of ink ejection openings 96 are arranged and formed over the width of recording area of paper Pa in a direction almost perpendicular to the transportation direction of paper Pa, that is, over the length of the shorter side of paper Pa. Ink flow passages respectively communicating with the plurality of ink ejection openings 96 are respectively provided with an electrothermal converter 94. The electrothermal converter 94 is controlled according to the drive control pulse signal from the controller (not shown).

By this operation, the electrothermal converter 94 is controlled according to the drive control pulse signal formed on the basis of the data representing the image formed on the recording surface of paper Pa, whereby the ink is heated by the electrothermal converter 94 and ejected towards the recording surface of paper Pa through each ink ejection opening 96.

The printing element board 92 is made, for example, using a silicon wafer of 0.5 to 1 (mm) in thickness. On the printing element board 92, as shown in FIG. 12A, five elongate ink supply ports 95 arranged in parallel to each other are formed corresponding to the inks and treatment liquid used.

On both sides of each ink supply port 95, ink chambers 93 are formed in two rows with the ink supply port 95 disposed therebetween. The respective ink chambers 93 are arranged along the longitudinal direction of the ink supply ports 95 at predetermined intervals. Each ink chamber 93 is provided with an electrothermal conversion element 94 as the printing element and an ejection opening 96 formed in opposition to the electrothermal conversion element 94 for ejecting an ink droplet or the like.

Figure 12A:
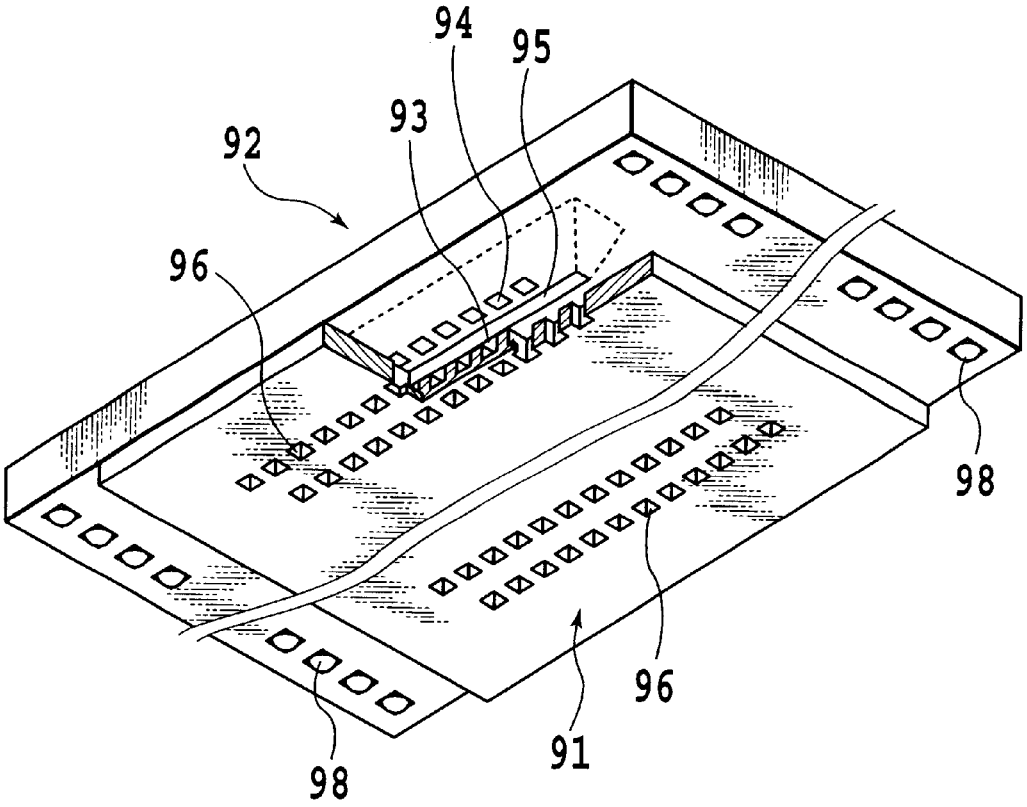
FIG. 12A and FIG. 12B are together a perspective diagram including partial cutaway showing an external view of the example of the printing element board provided in the printing head, and an external view of another example of the printing element board provided in the printing head, respectively.

In FIG. 12A, the two rows of the respective ejection openings 96 parallel to each other with the ink supply port 95 disposed therebetween are arranged in the form of a so-called zigzag, staggered by a half pitch relative to each other. Since the interval of the ejection openings 96 arranged along the longitudinal direction of the ink supply ports 95 in correspondence to each color ink or the like is arranged with a pitch of 600 dpi of the ink chamber corresponding to the ejection openings of each row, the ejection openings are set apparently in an arrangement state of a high density of 1200 dpi.

Further, the electrothermal conversion element 94 and the electrical wiring formed of aluminum or the like for supplying the power to the electrothermal conversion element 94 are formed on the surface of the silicon wafer by the film formation technology. The other terminal of the electrical wiring is formed of gold or the like as a bump contact 98 protruding from the surface of the printing element board 92.

The electrothermal conversion element 94 is part of, for example, a heat generation resistor layer not covered with the electrical wiring formed of aluminum or the like. The heat generation resistor layer is formed of, for example, TaN, TaSiN, Ta—Al or the like and has a sheet resistance of 53 Ω. Further, these electrothermal conversion element 94 and electrical wiring are covered with a protective layer 20 formed of silicon nitride (SiN) with a thickness of $4000\times10^{-10}$ (m) (4000 angstrom). Further, the surface of the protective layer 20 on the electrothermal conversion element 94 is provided with a cavitation resistant layer formed of tantalum (Ta) with a thickness of $2300\times10^{-10}$ (m) (2300 angstrom).

The above-described ink supply port 95 utilizes the crystal orientation of silicon wafer used as the printing element board 92, which is formed by anisotropic etching. That is, when the silicon wafer surface is of the crystal orientation of <100> and has <111> crystal orientation in its thickness direction, an alkaline anisotropic etching solution such as potassium hydroxide (KOH), tetramethylammonium hydroxide (TMAH) or hydrazine is used to perform etching of a desired depth with a selectivity in the etching direction. Further, the ink chamber 93 and the ejection opening 96 are formed by using the photolithographic technology. By supplying a drive power to the electrothermal conversion element 94, for example, an ink droplet of 4 picoliters is ejected from the ejection opening.

Figure 12B:
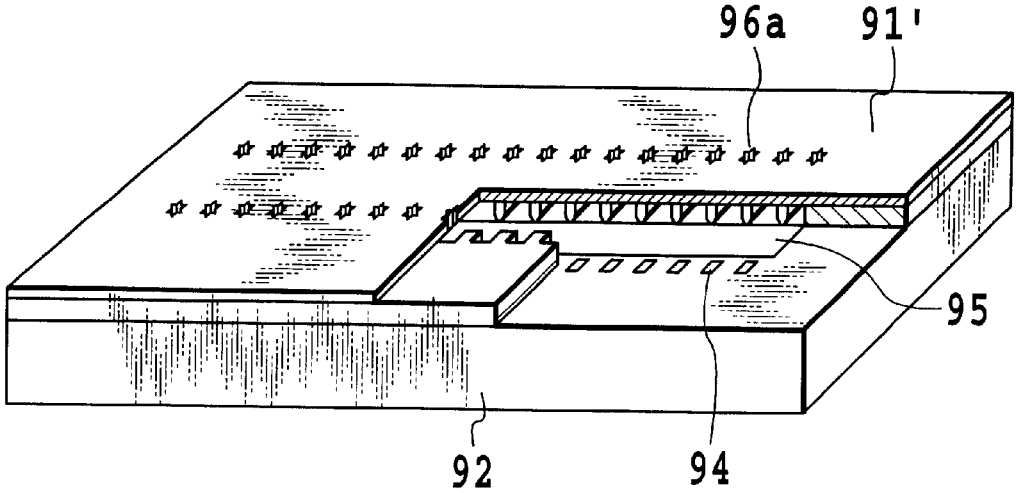

In the example shown in FIG. 12A, the ejection opening 96 is circular-shaped; however, the present invention is not limited to such an example, for example, as shown in FIG. 12B, the shape of the ejection opening 96*a* of the ink ejection opening formation surface 91' may be rectangular or polygonal star-form.

At this moment, on the recording surface of paper Pa, printing operation of the print heads 6M to 6B is successively carried out from the print head 6Y to build up the respective inks to form an image, and finally, the treatment liquid is ejected by the print head 6T, thereby performing an insolubilization treatment of the image. The upper part of the print head 6Y to 6T is supported by a print head support member 10B which will be described later.

The moving up and down apparatus 10 comprises four screw shafts 22 respectively provided along the vertical moving direction of the print heads 6Y to 6T at the respective comers of the print head support member 10B, four pulleys 24 having female screw holes engaged with the screw shafts 22, rotatably supported by respective bracket members 26 of the base plate 14, spring members 30A and 30B as urging member for urging the respective screw shafts 22 and the print head support member 10B upward, and a stepping motor 36 for rotating the respective pulleys 24 through a timing belt 28.

The respective screw shafts 22 are provided in parallel to each other, with an end thereof being fixed to the upper end surface of the four comers of the print head support member 10B. The other end of each screw shaft 22 penetrates a through hole provided in the base plate 14 and extends upward.

An end of the base plate 14 is bent and fixed to an enclosure 12 in the apparatus. On the flat surface of the base plate 14, bracket members 26 for supporting the respective pulleys 24 are provided corresponding to the respective pulleys 24. Between one side of the pair of the screw shafts 22 across the lower side transportation path, a stepping motor 36 is provided which is supported by the bracket member. A pulley is fixed to an output shaft of the stepping motor 36. The respective pulleys 24 and a pulley provided on an output shaft of the stepping motor 36 are wound round with a timing belt 28. Further, between the pulley provided on the output shaft of the stepping motor 36 and the pulleys 24, idle rollers 38A and 38B are respectively provided.

The stepping motor 36 is controlled according to the drive control pulse signal from the controller (not shown). Therefore, when the stepping motor 36 is made operative to be rotated in the direction shown by arrow of FIG. 1, since the respective pulleys 24 are rotated in the same direction, the respective screw shafts 22 are moved up by a predetermined amount along with the print head support member 10B and the print heads 6Y to 6B.

On the other hand, when the stepping motor 36 is made operative to be rotated in the direction opposite to that shown by the arrow of FIG. 1, since the respective pulleys 24 are rotated in the same direction, the respective screw shafts 22 are moved down by a predetermined amount along with the print head support member 10B and the print heads 6Y to 6B.

Further, on the side perpendicular to the transportation direction of paper Pa in the base plate 14, spring members 30A and 30B are provided which are respectively wound round support shafts 32A and 32B. Both ends of the support shafts 32A and 32B are supported on a pair of stays 34A and 34B integrally molded with the base plate 14. Between the stays 34A and 34B, openings 14*a* are formed respectively. Ends of the spring members 30A and 30B are respectively connected to a coupling 10A of the print head support member 10B.

Figure 3:
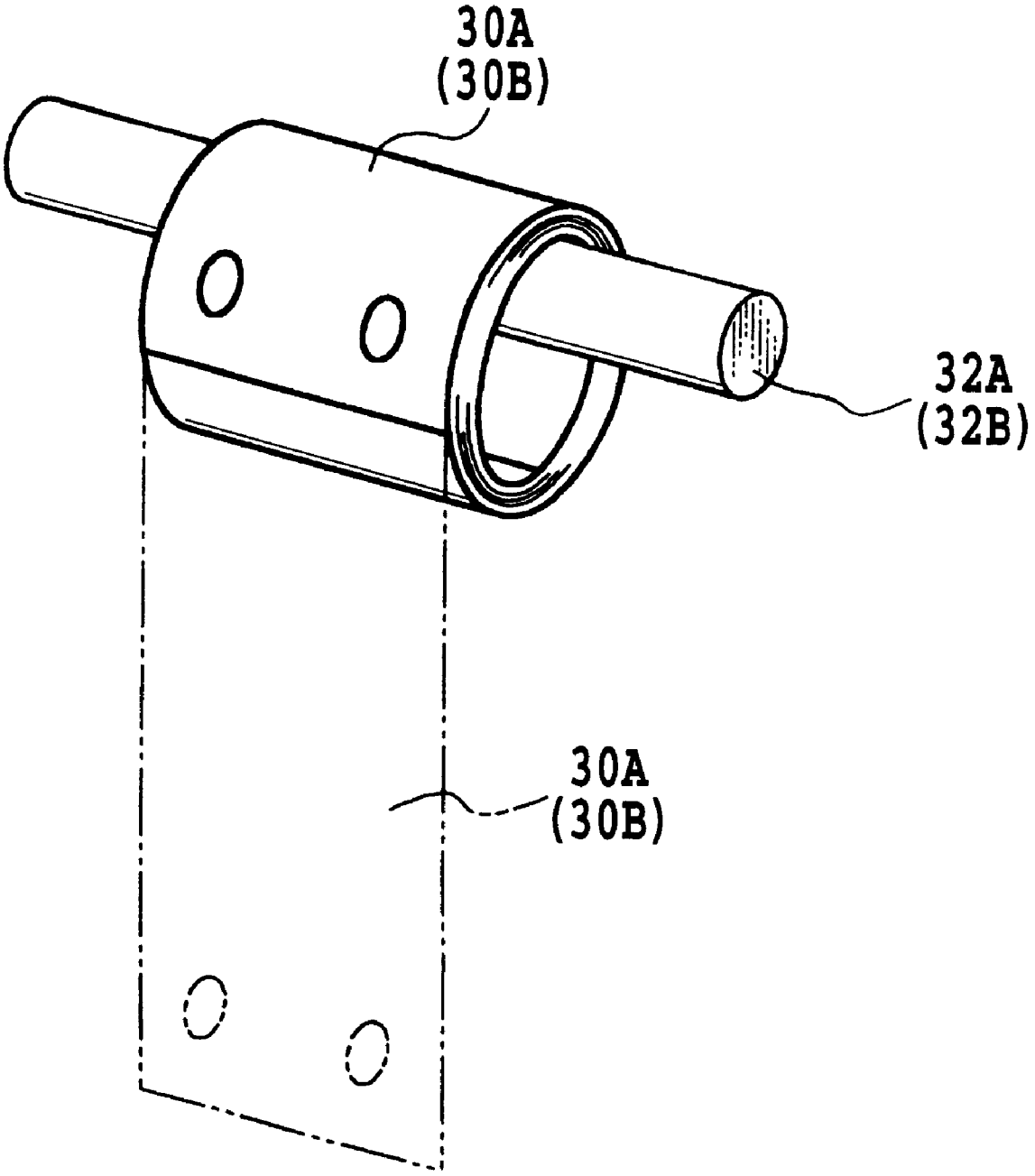
FIG. 3 is a perspective diagram showing a spring member used in the first embodiment of the moving up and down apparatus of print head according to the present invention.

The spring members 30A and 30B, as shown in FIG. 3, are respectively wound in the form of a closely wound spiral-spring round the support shafts 32A and 32B.

When the print head support member 10B connected with an end of the spring members 30A and 30B is moved down, the end of the spring members 30A and 30B is pulled out as shown by the chain double-dashed line in FIG. 3.

Figure 4:
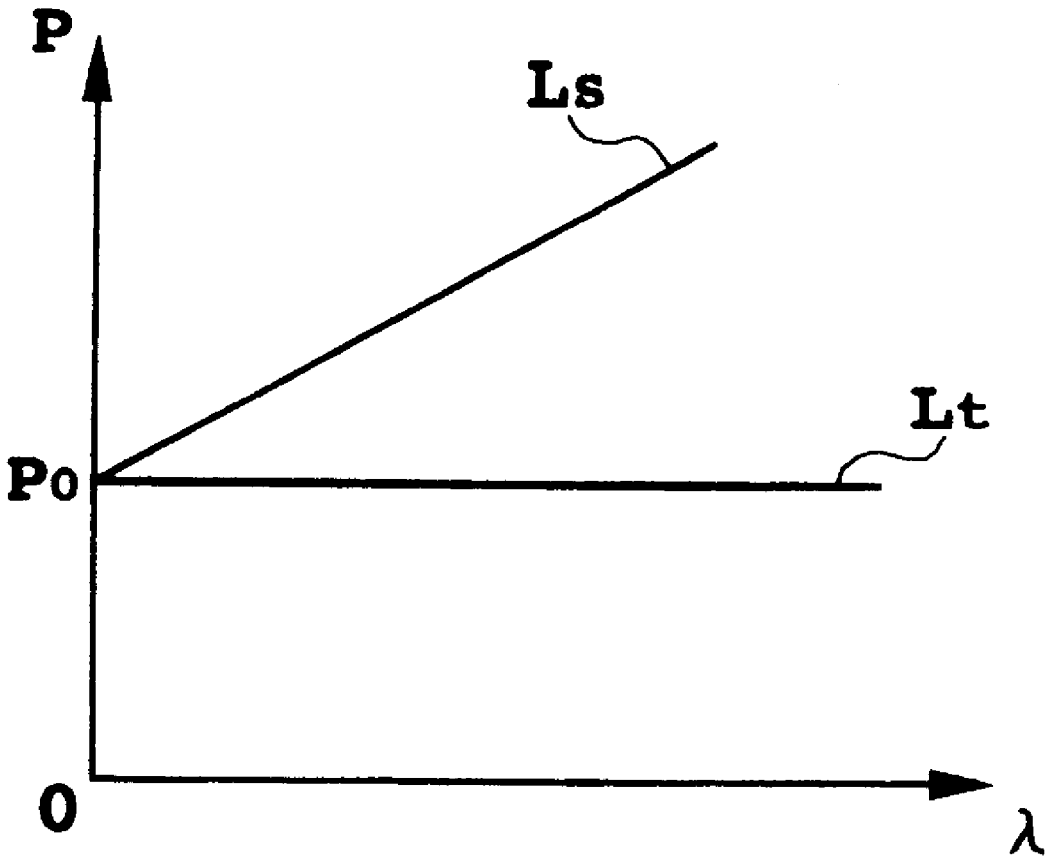
FIG. 4 is a characteristic diagram used for explaining the operation of the spring member shown in FIG. 3.

At this moment, a tension P applied to the print head support member 10B is, as shown in FIG. 4, a predetermined value Po independent of increase or decrease of a pull-out amount $\lambda$ of the spring members 30A and 30B.

FIG. 4 shows the relationship between the tension P of the spring members 30A and 30B and the pull-out amount with the tension P plotted on the axis of ordinates and the pull-out amount X plotted on the axis of abscissas. In general, a tension P of a coil spring, as shown by a straight line Ls of FIG. 4, is increased in proportion to an elongation from the initial value, that is, in proportion to the pull-out amount $\lambda$., on the other hand, the tension P of the spring members 30A and 30B, as shown by a straight line Lt, is maintained at a predetermined value Po independent of the pull-out amount $\lambda$..

Therefore, in the spring members 30A and 30B, the tension of the predetermined value Po is always applied in a direction to move up the print head support member 10B independent of the vertical moving amount of the print head support member 10B. By this operation, the thread ridge of the screw shaft 22 is contacted against the root of female screw hole of the pulley 24, so that a play between the thread ridge of the screw shaft 22 provided in the print head support member 10B and the root of female screw hole of the pulley 24, that is, the backlash is decreased. The tension of the predetermined value Po of the spring members 30A and 30B is, for example, set to a value equal to about a half the total weight of the print head support member 10B and the print heads 6Y to 6T. As a result, also in the recovery processing or the like, even when the print heads 6Y to 6T are pressed towards the upper side which is the opposite direction of gravitational direction by the recovery processing units 8Y to 8T, since the backlash is decreased, there is no danger that the print heads 6Y to 6T are moved upper than the predetermined position, thereby performing good recovery processing and wiping.

Further, the spring members 30A and 30B are provided in two places, however, the construction is not limited to this example, and they may be provided in three or more places.

As described above, by urging the print head support member 10B by the spring members 30A and 30B, drive force required for the stepping motor 36 to rotate the respective pulleys for vertically moving the print head support member 10B and the print heads 6Y to 6T is decreased. Therefore, it is possible to employ a stepping motor 36 of a relatively low-power.

Figure 5:
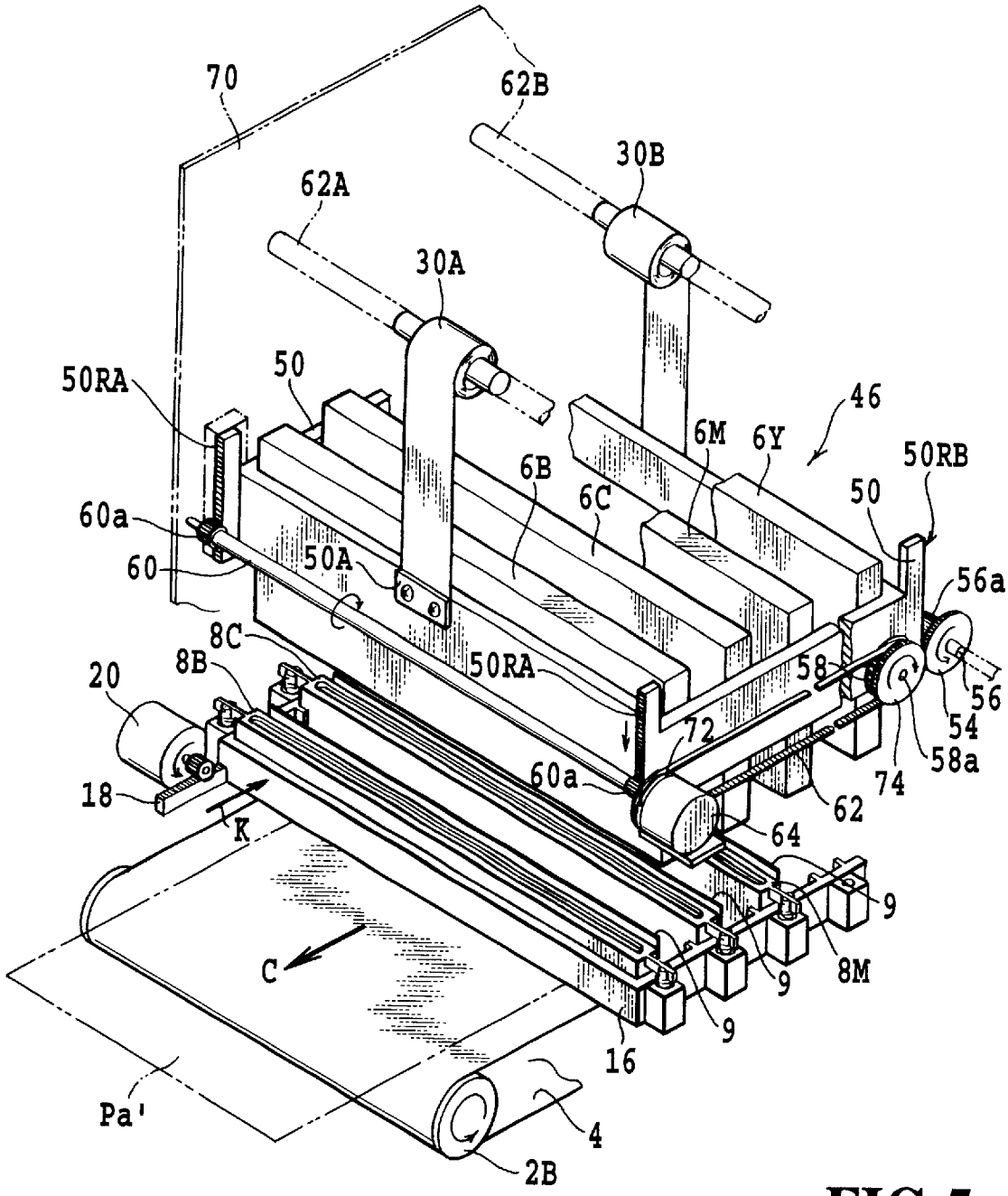
FIG. 5 is a perspective diagram showing a second embodiment of the moving up and down apparatus of print head according to the present invention, along with an ink-jet printing apparatus to which the invention is applied.

FIG. 5 shows a brief construction of an important point of a second embodiment of the moving up and down apparatus of print head according to the present invention.

In the example shown in FIG. 1, the moving up and down apparatus comprises the screw shafts 22 and the pulleys 24, however, instead, the moving up and down apparatus comprises racks 50RA and 50RB provided in a print head support member 50, and pinion gears 60*a* and 56*a* engaged with the racks 50RA and 50RB. In the example shown in FIG. 5, the same components as those shown in FIG. 1 are indicated by the same reference numerals, and overlapping detailed description thereof is omitted.

The print head support member 50 disposed above the transportation path of paper Pa holds inside thereof the above print heads 6Y, 6M, 6C, and 6B successively from the upstream side to the down stream side of the transportation path. The print head support member 50 is supported to be vertically movable between enclosures 70 disposed in opposition to each other with predetermined intervals.

The moving up and down apparatus 46 comprises racks 50RA and 50RB provided along the vertical moving direction of the print heads 6Y to 6B at the respective comers of ends corresponding to the downstream side and upstream side of the transportation path of the print head support member 50, a rotary shaft 60 having pinion gears engaged with the respective racks 50RA, a drive motor 64 connected to an end of the rotary shaft 60, a rotary shaft 56 having pinion gears 56*a* engaged with the respective racks 50RB, and the spring members 30A and 30B as urging member of which an end is connected to the print head support member 50 for urging the print head support member 50 and the rack 50RA and 50RB towards the upper side.

The racks 50RA and 50RB, when moving up and down, are guided by an inside surface of the enclosure 70.

Further, one end of the rotary shaft 60 is rotational moveably supported by the enclosure 70, and the other end of the rotary shaft 60 is connected to an output shaft of the drive motor 64. The drive motor 64 is fixed to the enclosure 70 through a bracket member. The drive motor 64 is controlled according to the drive control signal from the controller (not shown). At the other end of the rotary shaft 60, a pulley 72 is further fixed.

On a wall surface portion connected with the racks 50RA and racks 50RB of the print head support member 50, a pulley 58 is provided corresponding to the pulley 72. The pulley 58 is rotational moveably supported by a support shaft 58*a* provided on the wall surface. A timing belt 62 is provided between the pulley 72 and the pulley 58.

Further, the support shaft 58*a* is fixed with a gear 74. The gear 74 is engaged with a gear 54 fixed to an end of the rotary shaft 56. Both ends of the rotary shaft 56 are rotational moveably supported by the enclosure 70, respectively.

Therefore, when the drive motor 64 is made operative to rotate the rotary shaft 60 and the pulley 72 in the direction shown by the arrow of FIG. 5, since the pulley 58 and the gear 74 are rotated in the same direction, the gear 54 and the rotary shaft 56 are rotated in the direction shown by the arrow of FIG. 5, thereby moving down the print head support member 50 by a predetermined amount.

On the other hand, when the drive motor 64 is made operative to rotate the rotary shaft 60 and the pulley 72 in the direction opposite to the direction shown by the arrow of FIG. 5, since the pulley 58 and the gear 74 are rotated in the same direction, the gear 54 and the rotary shaft 56 are rotated in the direction opposite to the direction shown by the arrow of FIG. 5, thereby moving up the print head support member 50 by a predetermined amount.

Further, a connection 50A provided on the side perpendicular to the transportation direction of paper Pa in the print head support member 50 is connected with an end of the spring members 30A and 30B wound round the support shaft 62A and 62B. Both ends of the support shafts 62A and 62B are supported by the enclosure 70, respectively.

Therefore, also in this construction, in the recovery processing or the like, even when the print heads 6Y to 6T are pressed towards the upper side opposite to the gravitational direction by the recovery processing units 8Y to 8T, since the backlash between the racks 50RA and 50RB and the pinion gears 60*a* engaged with the respective racks 50RA is decreased, there is not a fear that the print heads 6Y to 6T are moved up more than the predetermined position, thereby performing good recovery processing and wiping.

Figure 8:
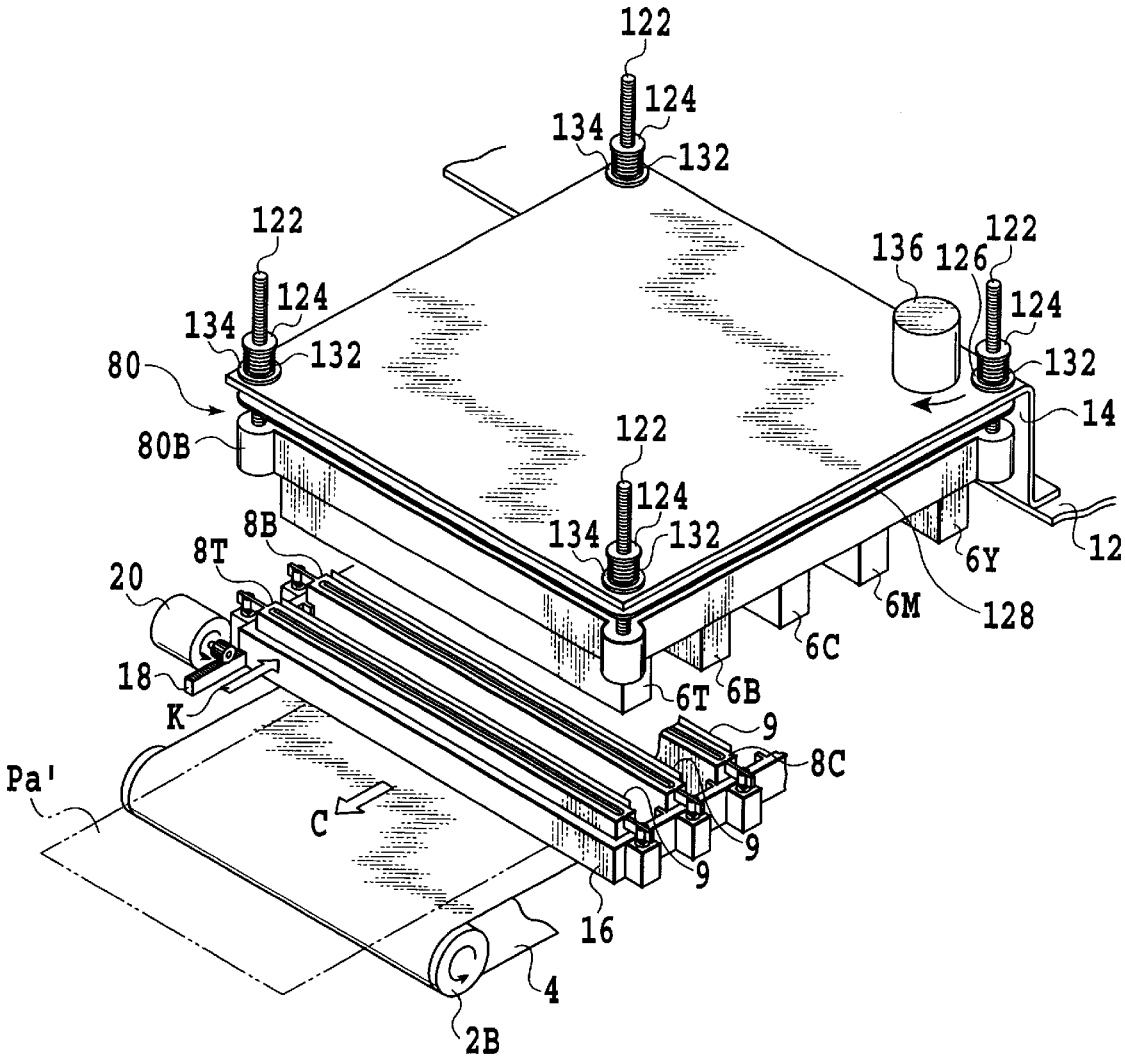
FIG. 8 is a perspective diagram showing the third embodiment of the moving up and down apparatus of print head according to the present invention, along with an ink-jet printing apparatus to which the invention is applied.
Figure 9:
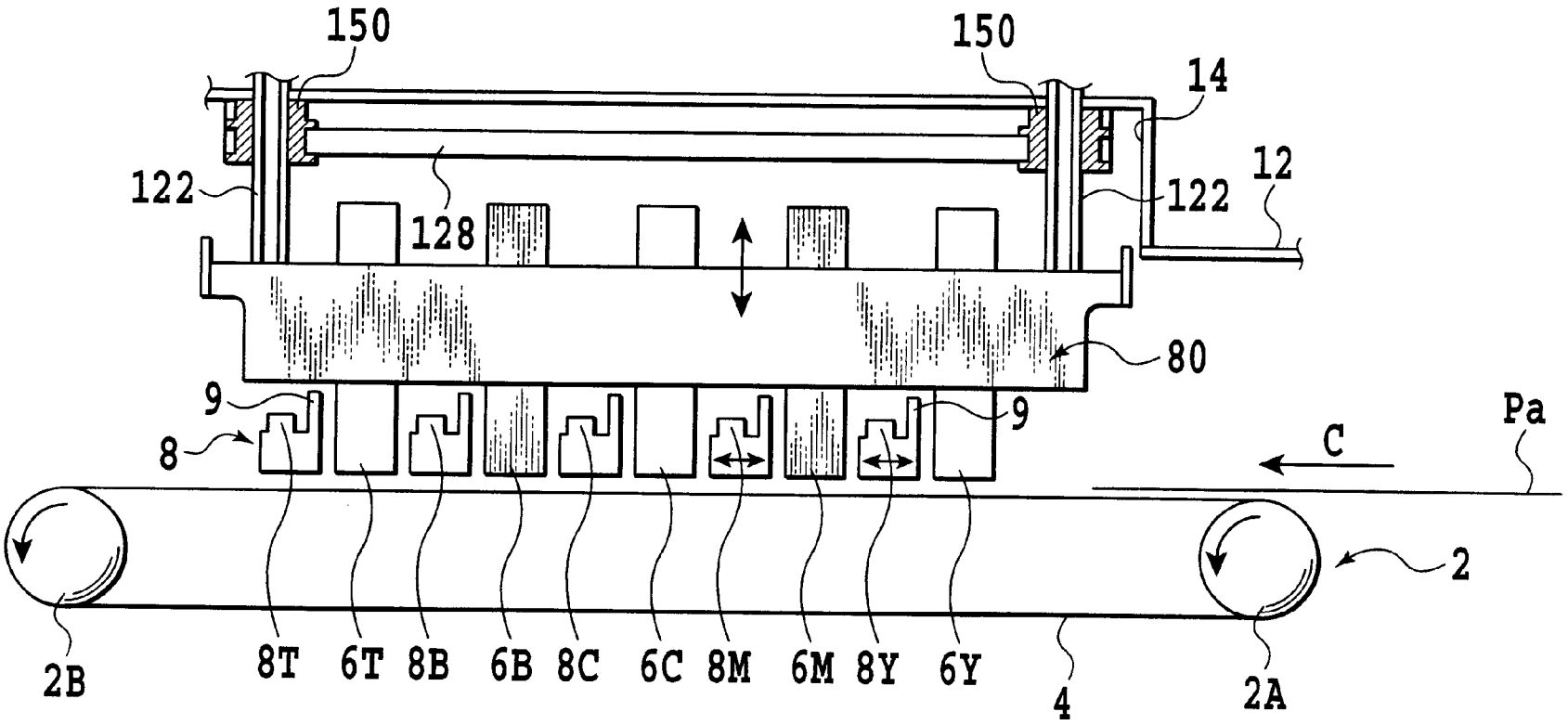
FIG. 9 is a sectional diagram schematically showing the configuration in the example shown in FIG. 8.

FIG. 8 and FIG. 9 show a brief construction of an important point of the third embodiment of the moving up and down apparatus of print head according to the present invention, along with the construction of an ink-jet printing apparatus to which the invention is applied.

In FIG. 8, the ink-jet printing apparatus comprises a transportation part 2 for transporting paper Pa as a printing medium according to the printing operation of the print heads 6Y to 6T which will be described later, recovery processing units 8 disposed above the transportation part 2 for performing recovery processing of the print heads 6Y to 6T, print heads 6Y to 6T for performing printing operation to the recording surface of paper Pa, and a moving up and down apparatus 80 for bringing the print heads 6Y to 6T close to the recording surface of paper pa, or to a stand-by position away relative to the transportation part 2. In FIG. 8, a state is shown in which the print heads 6Y to 6T are disposed at the printing position, and the recovery processing units 8 at the stand-by position.

The transportation part 2 comprises transportation rollers 2A and 2B disposed in opposition at the upstream side and the downstream side of the transportation path formed along the direction shown by arrow C of FIG. 8 beneath the moving up and down apparatus 80 and the print heads 6Y to 6T, and a transportation belt 4 wound round the transportation rollers 2A and 2B, and although not shown, a drive motor connecting to an end of the transportation roller 2B for rotating the transportation roller 2B along with the transportation roller 2A through the transportation belt 4.

Length in the axial direction of the transportation rollers 2A and 2B, and width of the transportation belt 4, as shown in FIG. 8, are respectively set longer than the width of the predetermined paper Pa, and length of the transportation belt 4 along the transportation path is set longer than the length in the arrangement direction of the spring print heads 6Y to 6T.

The transportation belt 4, although not shown, generates a predetermined electric charge on the surface thereof by way of an electrostatic induction action of a static electrification device disposed at the upstream side of the transportation path, for attracting and transporting paper Pa by its attracting force.

The drive motor is controlled according to the drive control signal from the controller (not shown). By this operation, the transportation belt 4 intermittently transports the placed paper Pa according to the printing operation of the print heads 6Y to 6T.

The recovery processing unit 8, as shown in FIG. 8 and FIG. 9, comprises capping members 8Y, 8M, 8C, 8B and 8T provided corresponding to respective print heads 6Y, 6M, 6C, 6B and 6T which will be described later, and a plurality of blade members 9 provided adjacent to the respective capping members 8Y to 8T.

Since the capping members 8Y, 8M, 8C, 8B and 8T have the same structure each other, only the capping member 8T is described and description of other capping members 8Y to 8B is omitted.

The capping member 8T having an opening end at the upper side, when the print head 6T takes the predetermined stand-by position away from the transportation path, is moved to the direction shown by arrow K of FIG. 8. At this moment, its tip surface forming the periphery of the opening end is afterward moved down by a predetermined amount to closely contact with the entire ink ejection opening formation surface which is moved down and stopped. Further, the inside of the capping member 8T has a liquid absorber which once absorbs and holds a treatment liquid ejected from the print head 6T. The liquid absorbed by the liquid absorber is recovered into a waste liquid tank (not shown) through a waste liquid tube connected to the capping member 8T.

The capping member 8T is provided with a thin-plate formed blade member 9 nearly parallel and adjacent to the capping member 8T. The blade member 9, when the print head 6T takes a predetermined stand-by position, is moved to a direction opposite to that shown by arrow K of FIG. 8, so as to wipe off an ink or the like adhered to the ink ejection opening formation surface of the nearby print head 6T.

The respective capping members 8Y to 8B, as shown in FIG. 8, are connected by fixing in parallel to each other in a unit base 16 with predetermined intervals extending in a direction almost perpendicular to the transportation direction of paper Pa. The unit base 16 is supported by a guide member (not shown) to be capable of reciprocally moving by a predetermined distance along the transportation direction of paper Pa. The unit base 16 has spaces between the respective capping members 8Y to 8B so that the ink ejection portion of the respective print heads 6Y to 6T are possible to go in. At an end of the unit base 16, as shown in FIG. 8, a rack member 18 is provided. The rack member 18 is engaged with a pinion gear fixed to an output shaft of a drive motor 20. The drive motor 20 is provided in a part opposing an end of the capping member 8T of the enclosure of the apparatus.

The drive motor 20 is controlled according to the drive control pulse signal from the controller (not shown).

Therefore, when the print heads 6Y to 6T take predetermined stand-by positions, and the drive motor 20 is made operative to be rotated in one direction by a predetermined rotation angle, as shown in FIG. 8, the unit base 16 is moved in a direction shown by arrow K in association with movement of the rack member 18, so that the respective capping members 8Y to 8T are moved to a position just beneath the respective print heads 6Y to 6T. Then, after the respective print heads 6Y to 6T are moved down and stopped, a predetermined recovery processing, for example, suction or preliminary ejection operation of the respective print heads 6Y to 6T is performed to the respective print heads 6Y to 6T. As a result, clogging or the like of the ink ejection opening is eliminated.

On the other hand, when the print heads 6Y to 6T take predetermined stand-by positions, and the drive motor 20 is made operative to be rotated in the other direction by a predetermined rotation angle, the unit base 16 is moved in a direction opposite to the direction shown by arrow K. By this operation, the respective capping members 8Y to 8T are moved to the extremity of the downstream end side, or, between the respective print heads 6Y to 6T, and a wiping operation is performed by the blade member 9 to the ink ejection opening formation surface.

The print heads 6Y to 6B are successively arranged from the upstream side to the downstream side of the transportation path, which respectively eject yellow, magenta, cyan and black inks. The print head 6T ejects a treatment liquid for insolubilizing each ink adhered to the recording surface of paper Pa. The respective inks and treatment liquid are successively supplied from ink tanks and a treatment liquid tank (not shown).

The print heads 6Y to 6T are respectively of a bubble jet type, for example, described above and comprise printing element board 92 have an ink ejection opening formation surface 91 having a plurality of ink ejection openings formed on a part opposing the recording surface of the transported paper Pa.

Accordingly, described above, on the recording surface of paper Pa, printing operation of the print heads 6M to 6B is successively carried out from the print head 6Y to build up the respective inks to form an image, and finally, the treatment liquid is ejected by the print head 6T, thereby performing an insolubilization treatment of the image. The upper part of the print head 6Y to 6T is supported by a print head support member 80B which will be described later.

The moving up and down apparatus 80, as shown in FIG. 8 and FIG. 9, comprises four screw shafts 122 respectively provided along the vertical moving direction of the print heads 6Y to 6T at the respective comers of the print head support member 80B, three pulleys 150 having female screw holes engaged with three of the four screw shafts 22, a composite rotary member 130 (see FIG. 6) having female screw holes engaged with the remnant screw shaft 122 of the four screw shafts 122, an urging mechanism 121 (see FIG. 7) for urging the screw shafts 122 relative to the respective pulleys 150 and the composite rotary member 130 in one direction along the axial direction, and a stepping motor 136 for rotating the composite rotary member 130 and the respective pulleys 150 through the timing belt 128.

The four screw shafts 122, as shown in FIG. 8 are provided in parallel to each other, with an end thereof being fixed to the upper end surface of the four corners of the print head support member 80B. The other end of one of the four screw shafts 122, as shown in FIG. 6, is engaged with the female screw hole 130*a* of the composite rotary member 130 rotational moveably provided on the base plate 14.

An end of the base plate 14 is bent and fixed to an enclosure 12 in the apparatus. On the flat surface of the base plate 14, bracket members 126 for guiding the upper parts of the respective screw shafts 122 are provided corresponding to the respective screw shafts 122.

Figure 6:
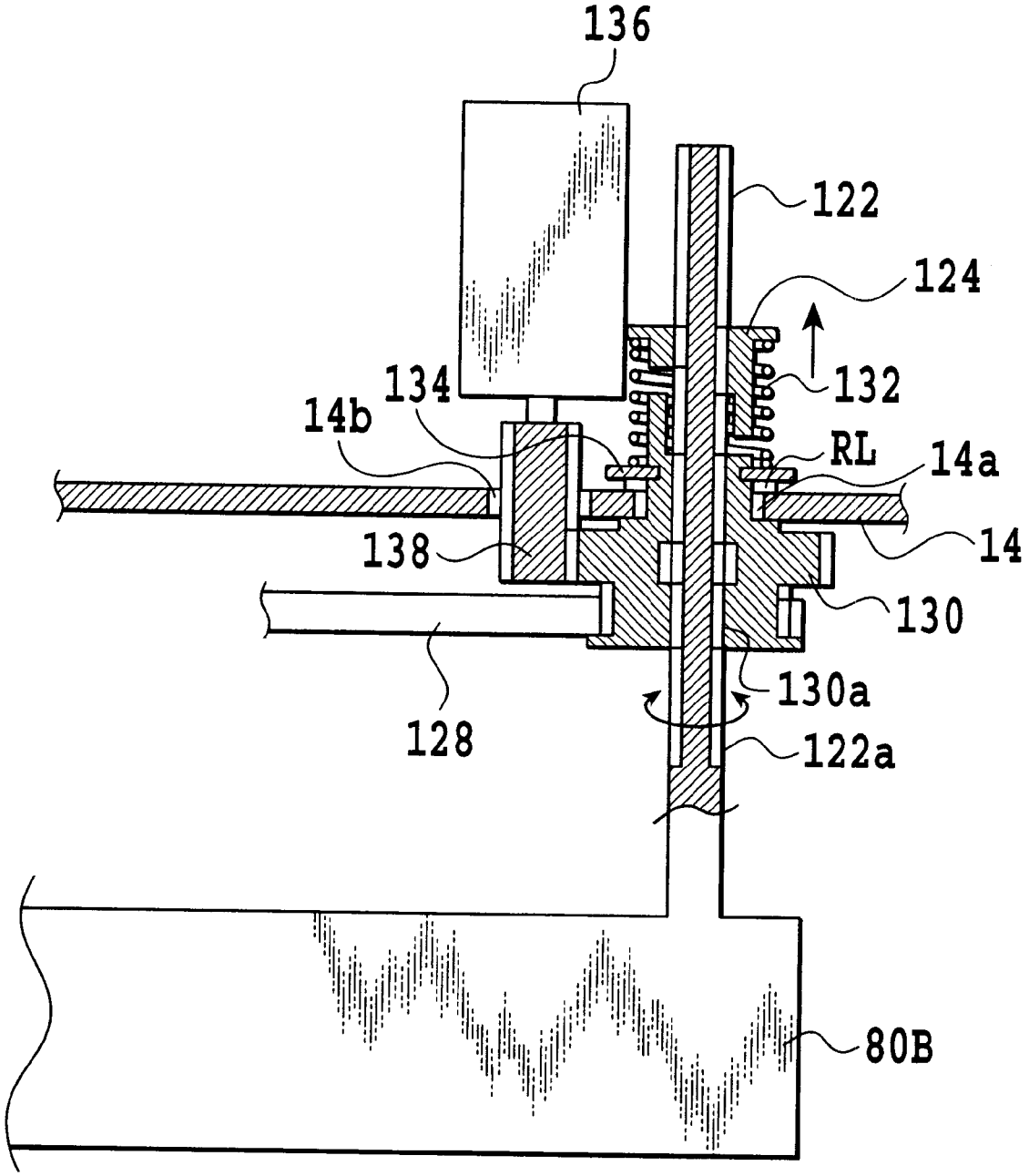
FIG. 6 is a sectional diagram showing an important point of the drive part provided with an urging mechanism in a third embodiment of the moving up and down apparatus of print head according to the present invention.
Figure 7:
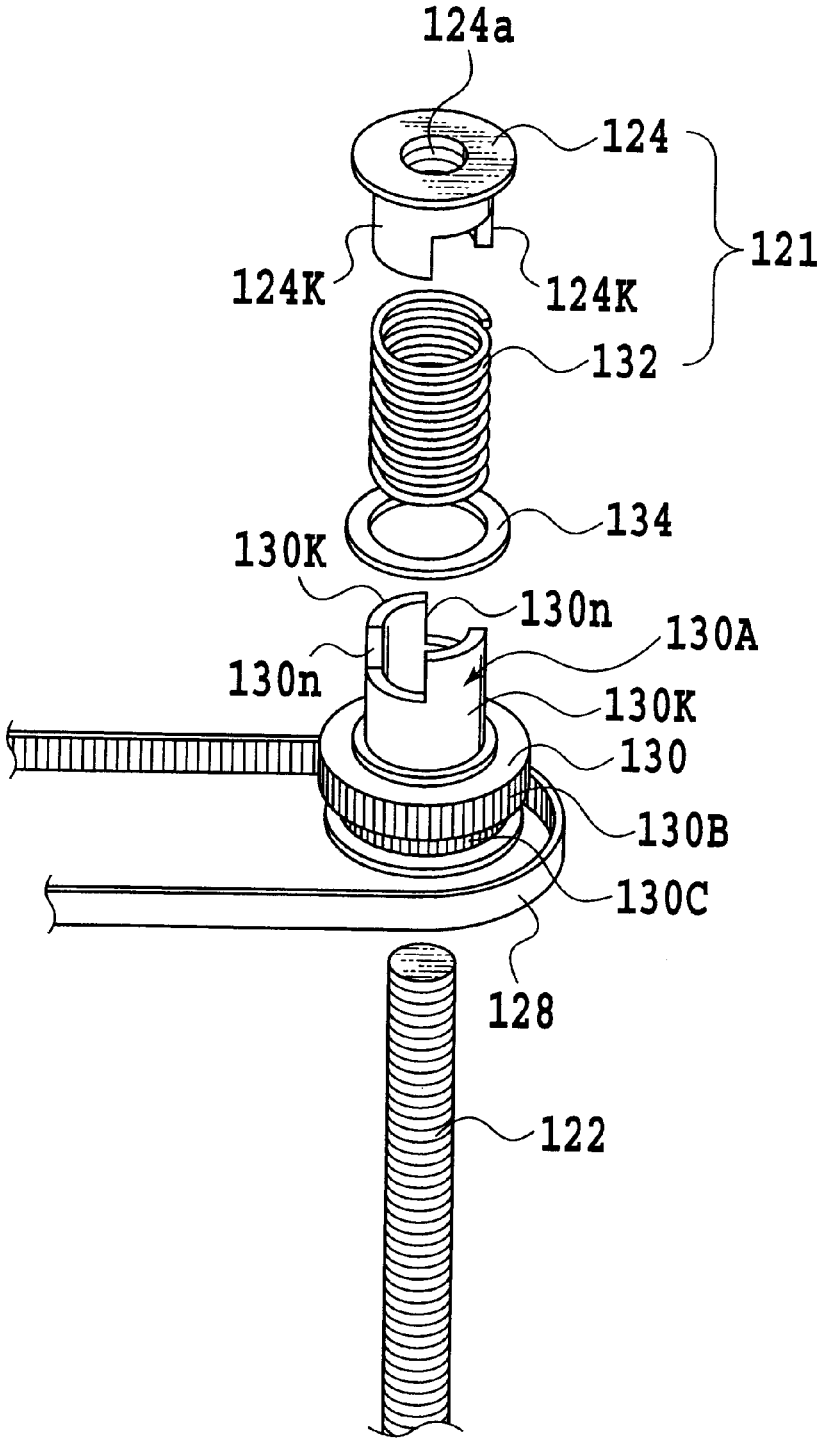
FIG. 7 is an exploded perspective diagram showing partially exploded components in the example shown in FIG. 6.

The composite rotary member 130, as shown in FIG. 6 and FIG. 7, comprises a belt pulley portion 130C looped the timing belt 128, a gear teeth portion 130B formed integrally with and adjacent to the belt pulley portion 130C and engaged with the pinion gear 138 which will be described later, and an engaging portion 130A provided at the center of the gear teeth portion 130B and engaged with a spring hold member 124 which will be described later. Further, the composite rotary member 130 has female screw holes 130*a* engaged with the screw shafts 122 penetrating the inside of the belt pulley portion 130C, the gear teeth portion 130B, the engaging portion 130A and the spring hold member 124.

On the outer periphery of the belt pulley portion 130C, irregularities engaged with the inner surface of the timing belt 128 are formed. The timing belt 128 is looped around three pulleys 150, and the belt pulley portion 130C of the composite rotary member 130.

The gear teeth portion 130B is engaged with the pinion gear 138 fixed to the output shaft of the stepping motor 136. The stepping motor 136 is fixed to the base plate 14 by a support member (not shown) so that the axial line of the output shaft thereof is nearly parallel to the center axial line of the screw shaft 122. The pinion gear 138 is engaged with the gear teeth portion 130B through a through hole 14*b* formed on the base plate 14.

The cylindrical engaging portion 130A of the composite rotary member 130 extends upward through a through hole 14*a* on the base plate 14. The engaging portion 130A, as shown in FIG. 7, has a cutout 130*n* and a claw portion 130*k* which oppose each other. Further, at the boundary portion of the engaging portion 130A with the gear teeth portion 130B, a groove for stopping a stop ring RL is formed. With this construction, the composite rotary member 130 is held by the stop ring RL and rotational moveably supported by the base plate 14. Still further, when the stepping motor 136 is operative, by moving rotationally the timing belt 128 through the pinion gear 138 and the composite rotary member 130, the pulley 150 is rotated. Therefore, the four screw shafts 122 are moved up and down along with the print head support member 80B according to the rotational direction of the pinion gear 138.

Above the engaging portion 130A, a spring hold member 124 engaged with the screw shaft 122 is provided. The spring hold member 124 has, for example, a flange engaged with an end of a metal-made compression coil spring 32, and a pair of claws portion 124*k* engaged with cutouts 130*n* of the engaging portion 130A of the composite rotary member 130, respectively. Further, the spring hold member 124 has at its center a female screw hole 124*a* engaged with the screw shaft 122. With this construction, the spring hold member 124 rotates in synchronization with the composite rotary member 130.

Between the spring hold member 124 and the foot of the engaging portion 130A of the composite rotary member 130, a compression coil spring 132 for urging the spring hold member 124 in a direction of separating from the engaging portion 130A thereof and a spring receiver 134 are wound round the outer periphery of the engaging portion 130A and the claw portion 124*k*.

Therefore, the urging force of the compression coil spring 132 applies in a direction shown by arrow in FIG. 6 between the spring hold member 124 and the foot of the engaging portion 130A of the composite rotary member 130. That is, the urging mechanism 121 is formed including the spring hold member 124 and the composite rotary member 130. Such an urging mechanism 121 is similarly provided for the remnant three screw shafts 122 and the three pulleys 150.

As a result, the flank of the thread of the screw shaft 122 and the flank of the thread of the spring hold member 124 and the composite rotary member 130 are contacted with a constant urging force without backlash irrespective of the vertical position of the print head.

The stepping motor 136 is controlled according to the drive control pulse signal from the controller (not shown). Therefore, when the stepping motor 136 is made operative to be rotated in the direction shown by arrow of FIG. 6, since the composite rotary member 130 and the respective pulleys 150 are rotated in the same direction, the respective screw shafts 122 are moved up by a predetermined amount along with the print head support member 80B and the print heads 6Y to 6B.

On the other hand, when the stepping motor 136 is made operative to be rotated in the direction opposite to that shown by the arrow of FIG. 6, since the composite rotary member 130 and the respective pulleys 150 are rotated in the same direction, the respective screw shafts 122 are moved down by a predetermined amount along with the print head support member 80B and the print heads 6Y to 6B.

Therefore, the flank of the thread of the screw shaft 122 provided on the print head support member 80B is contacted against the flank of the thread of the composite rotary member 130 and the pulleys 150 so that a play between the flank of the thread of the screw shaft 122 provided on the print head support member 80B and the flank of the female screw of the engaged composite rotary member 130 and the pulleys 150, that is, the backlash is decreased. As a result, also in the recovery processing or the like, even when the print heads 6Y to 6T are pressed towards the upper side which is the opposite direction of gravitational direction by the recovery processing units 8Y to 8T, since the backlash is decreased, there is no danger that the print heads 6Y to 6T are moved upper than the predetermined position, thereby performing good recovery processing and wiping.

Figure 10:
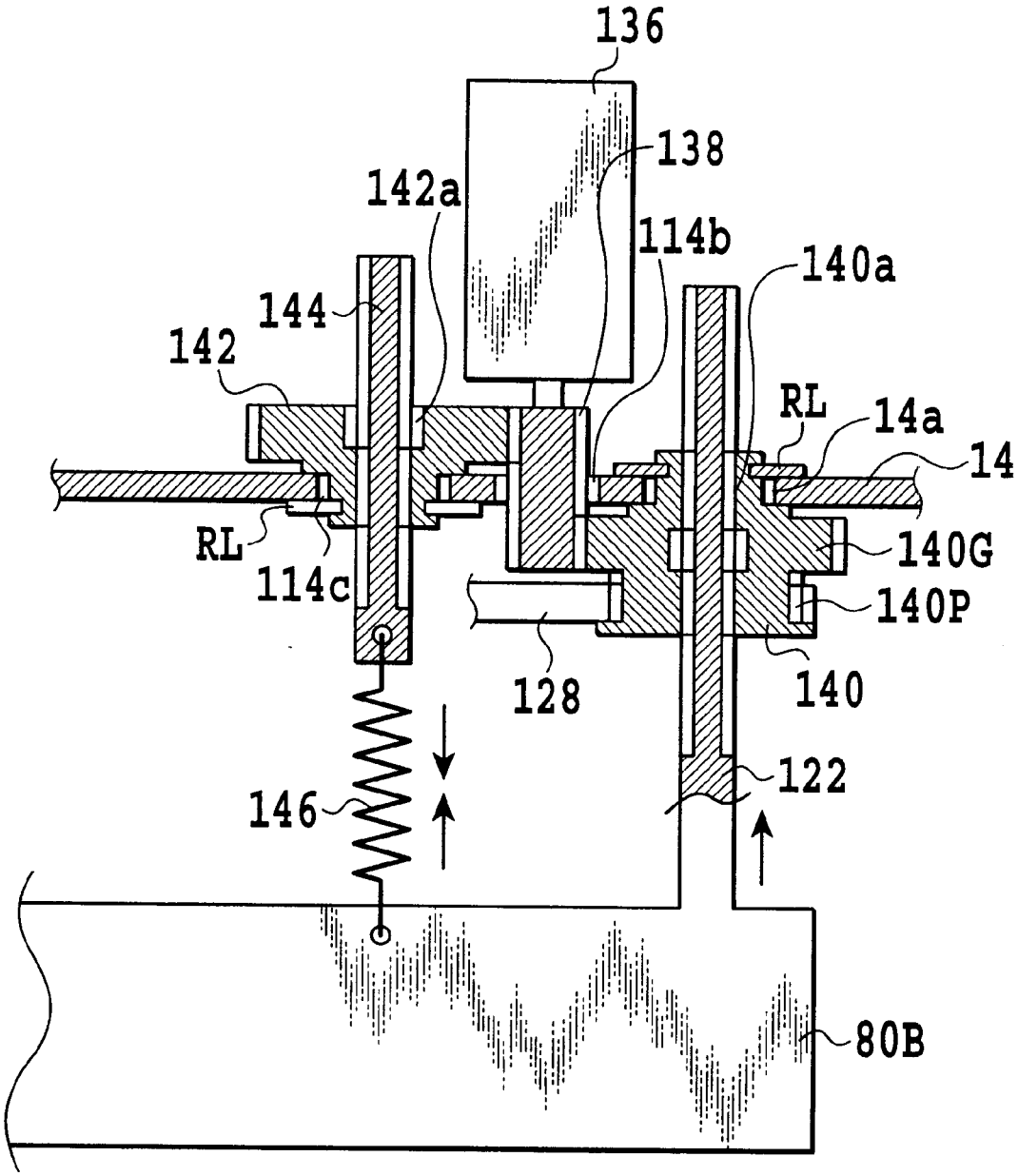
FIG. 10 is a partially sectional diagram showing an important point of the drive part provided with another example of urging mechanism in the third embodiment of the moving up and down apparatus of the print head according to the present invention.

FIG. 10 shows an important point of the drive part provided with another example of the urging mechanism used in the third embodiment of the moving up and down apparatus of print head according to the present invention. In the example shown in FIG. 10, the same components as those shown in FIG. 6 are indicated by the same reference numerals, and overlapping detailed description thereof is omitted.

In FIG. 6, the above-described urging mechanism is provided on the same shaft of the screw shaft 122, however, instead, in the example shown in FIG. 10, in order to decrease the backlash, an urging mechanism is provided for urging the screw shaft 122 by an urging force acting indirectly to a composite rotary member 140.

In FIG. 10, one of the four screw shafts 122 is supported to be vertically movable by the base plate 14 through the composite rotary member 140. The composite rotary member 140 comprises a gear portion 1406 engaged with the pinion gear 138, and a pulley portion 140P looped with the above timing belt 128. Further, the composite rotary member 140 is rotational moveably provided on the base plate 14 in the state that a boss of the gear portion thereof 1406 is inserted and protruded in the through hole 14*a* of the base plate 14. The boss is held on the base plate 14 by the stop ring RL provided in its groove. Still further, the composite rotary member 140 has in the inside a female screw portion engaging with the screw shaft 122.

On the other hand, the remnant three screw shafts 122 are supported on the base plate 14 to be vertically movable through a pulley (not shown). The pulley has in the inside a female screw portion engaging with the screw shaft 122. The female screw portion is formed to be the same forward screw direction as the screw direction of the axial direction of the female screw portion of the composite rotary member 140, that is, the thread cutting direction is the same each other.

Yet further, on the outer peripheral part of the pulley, irregularities engaging with the gear teeth portion formed inside the timing belt 128 are formed. With this construction, the timing belt 128 is wound round the pulley portion 140P of the composite rotary member 140 and the three pulleys.

The pinion gear 138 is engaged with the gear 142. The gear 142 is rotational moveably provided on the base plate 14 in the state that the boss of the gear portion thereof 1406 is inserted and protruded in the through hole 14*c* of the base plate 14. The boss is held on the base plate 14 by the stop ring RL provided in its groove.

The gear 142 has in the inside a female screw portion 142*a* engaging with the screw portion of a screw shaft 144. The screw shaft 144 is provided to be parallel to the axial line of the pinion gear 138 and the axial line of the screw shaft 122 to each other.

The screw shaft 144 and the female screw portion 142*a* are threads of the same pitch and phase as the female screw portion of the screw shaft 122 and the composite rotary member 140.

Between an end of the screw shaft 144 and the print head support member 80B, a tension coil spring 146 is provided, whereby the screw shaft 144 and the print head support member 80B are urged to be pulled to each other by an urging force by the tension coil spring 146 acting in the direction shown by the arrow. Therefore, the screw shaft 144 is urged to the gear 42 so as to decrease the backlash therebetween. Further, since the tension coil spring 146 does not change in height, the tension coil spring 146 urges with a constant urging force regardless of the vertical position of the print head.

Yet further, the screw shaft 122 is urged to the composite rotary member 140 by the urging force of the tension coil spring 146 acting in the direction shown by the arrow.

Therefore, the flank of the thread of the screw shaft 122 provided on the print head support member 80B is contacted against the flank of the thread of the composite rotary member 140 and the three pulleys so that a play between the flank of the thread of the screw shaft 122 provided on the print head support member 80B and the flank of the female screw of the engaged composite rotary member 140 and the three pulleys 150, that is, the backlash is decreased.

As a result, the same functions and effects as the above-described example can be obtained.

Figure 11:
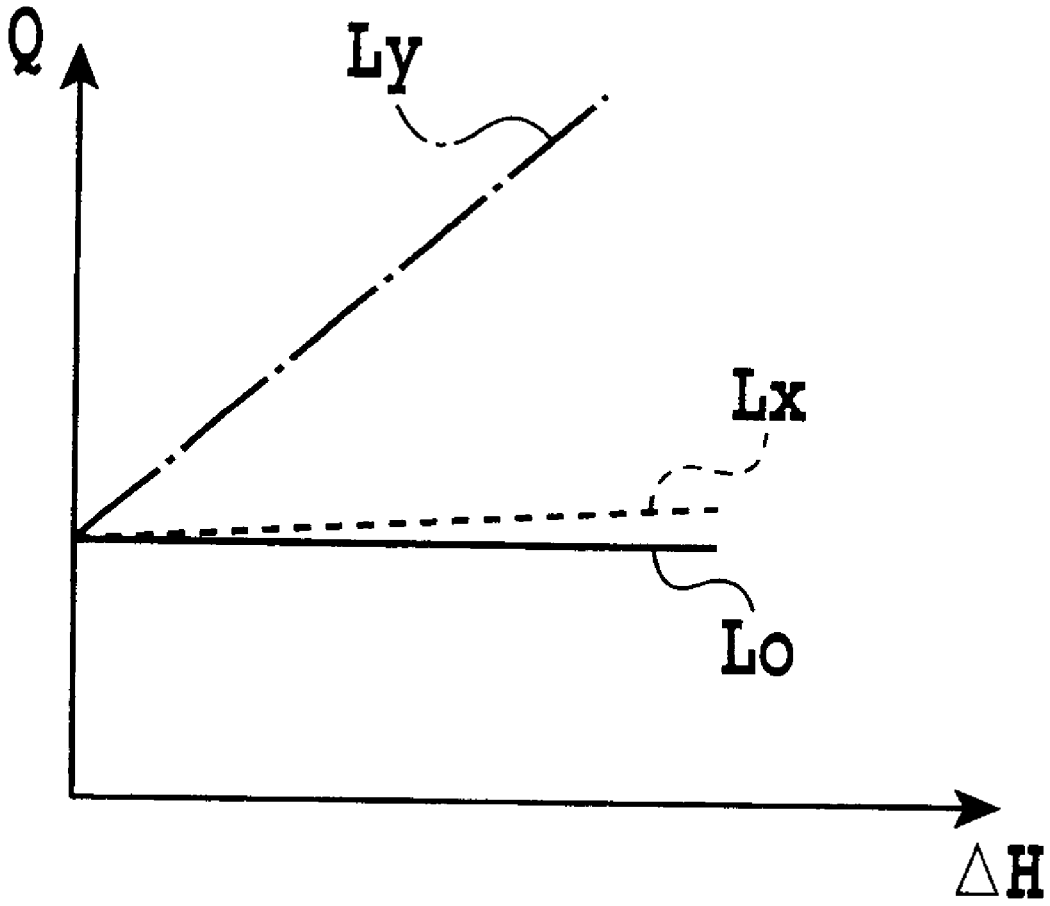
FIG. 11 is a characteristic diagram used for explaining the operation of the spring member shown in FIG. 6 and FIG. 10.

Further, FIG. 11 shows the relationship between the urging force Q and moving amount OH of the compression coil spring 132 or the tension coil spring 146, with the urging force Q of the compression coil spring 132 or the tension coil spring 146 plotted on the axis of ordinates and the moving amount ΔH of the print head support member plotted on the axis of abscissas.

For example, in the case of a vertical moving apparatus having a construction in which the deflection of the coil spring for reducing the above backlash varies with the moving amount of the print head support member, the urging force Q increases in proportion to the moving amount of the print head support member as the characteristic curve Ly.

Still further, the urging force of the spring members 30A and 30B shown in FIG. 3, as shown in FIG. 4, is constant macroscopically constant in a predetermined range of pull-out amount λ, however, since the spring members 30A and 30B in FIG. 3 vary in the outer diameter according to the pull-out amount λ, microscopically as shown by the characteristic curve Lx of FIG. 11, it may slightly increase in proportion to the moving amount of the print head support member.

On the other hand, in the case of the urging force Q of the compression coil spring 132 or the tension coil spring 146, since the deflection amount and outer diameter of the compression coil spring 132 or the tension coil 146 will not be changed, the urging force Q, as shown by characteristic curve Lo in FIG. 11, is maintained at a predetermined value Qo independent of the moving amount ΔH.

In the above-described example, in the urging mechanism, a coil spring is used as the elastic member, however, the present invention is not limited to this example, but other materials having elasticity, such as rubber materials, plastic materials and the like may naturally be used.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A moving up and down apparatus of a print head, comprising:

a print head support part for supporting said print head which performs an ejection of a liquid in order to perform a printing operation of printing on a recording surface of a printing medium;

a drive force transmitted part provided in said print head support part, arranged to receive and transmit a drive force for reciprocally moving said print head support part;

a drive force transmission part engaged with said drive force transmitted part through a gear teeth part for transmitting the drive force to said drive force transmitted part;

a drive force supply part connected to said drive force transmission part for supplying the drive force to said drive force transmission part; and an urging member arranged to urge said print head support part in a predetermined direction, said urging member including an elastic member.

2. The moving up and down apparatus of a print head as claimed in claim 1, wherein said urging member urges said print head support part in one direction with an urging force greater than a weight of said print head support part and said print head so as to remove play of a gear teeth part between said drive force transmitted part and said drive force transmission part.

3. The moving up and down apparatus of a print head as claimed in claim 1, wherein said urging member always urges said print head support part in one direction with a constant urging force.

4. The moving up and down apparatus of a print head as claimed in claim 1, wherein said urging member comprises a plurality of spring members.

5. The moving up and down apparatus of a print head as claimed in claim 1, wherein said urging member urges said print head support part in a direction against gravity.

6. The moving up and down apparatus of a print head as claimed in claim 1, wherein said drive force transmitted part includes a screw shaft provided on said print head support part and extending along a moving direction of said print head support part, and said drive force transmission part includes a pulley having a female screw hole engaged with said screw shaft.

7. The moving up and down apparatus of a print head as claimed in claim 1, wherein said drive force transmitted part includes a rack part provided on said print head support part and extending along a moving direction of said print head support part, and said drive force transmission part includes a pinion gear engaged with said rack part.

8. The moving up and down apparatus of a print head as claimed in claim 1, wherein said print head support part is disposed to be relatively reciprocally movable relative to a recovery processing unit for performing wiping to said print head so as to maintain printing operation of said print head normal.

9. A moving up and down apparatus of a print head comprising:

a print head support part for supporting a print head for performing a printing operation of printing on a recording surface of a printing medium;

a screw shaft member provided on said print head support part in which a first screw part is formed along a moving direction of said print head support part;

a drive force transmission member having a second screw part engaged with said first screw part of said screw shaft member for transmitting a supplied drive force to said screw shaft member; and an urging member for directly or indirectly urging said screw shaft member or said drive force transmission member in a direction, said urging member including an elastic member.

10. The moving up and down apparatus of a print head as claimed in claim 9, wherein said urging member urges said screw shaft member or said drive force transmission member directly or indirectly in a direction for removing play between said first screw part of said screw shaft member and said second screw part of said drive force transmission member.

11. The moving up and down apparatus of a print head as claimed in claim 9, wherein said print head support part is disposed to be relatively reciprocally movable relative to a recovery processing unit for performing a recovery processing to said print head so as to maintain printing operation of said print head normal.

12. A moving up and down apparatus of a print head comprising:

a print head support part for supporting a print head for performing a printing operation of printing on a recording surface of a printing medium;

a first screw shaft member provided on said print head support part in which a first screw part is formed along a moving direction of said print head support part;

a first drive force transmission member having a second screw part engaged with said first screw part of said first screw shaft member for transmitting a supplied drive force to said first screw shaft member;

a second screw shaft member having a third screw part formed along a moving direction of said print head support part;

a second drive force transmission member having a fourth screw part engaged with a third screw part of said second screw shaft member for transmitting a supplied drive force to said second screw shaft member in a same direction as a drive force transmission direction of said first drive force transmission member;

a drive force supply part connected to said first drive force transmission member and said second drive force transmission member so as to supply the drive force; and an urging member disposed between said second screw shaft member and said print head support part for urging said first screw shaft member or said first drive force transmission member in a direction, said urging member including an elastic member.

13. The moving up and down apparatus of a print head as claimed in claim 12, wherein said urging member is disposed between said second screw shaft member and said print head support part for urging said first screw shaft member or said first drive force transmission member in a direction so as to remove play at least between said first screw part of said first screw shaft member and said second screw part of said first drive force transmission member.

14. A printing apparatus comprising:

a print head for ejecting a liquid in order to perform a printing operation of printing on a recording surface of a printing medium;

a print head support part for supporting said print head;

a drive force transmitted part provided in said print head support part for receiving and transmitting a drive force for reciprocally moving said print head support part;

a drive force transmission past engaged with said drive force transmitted part through a gear teeth part for transmitting the drive force to said drive force transmission part;

a drive force supply part connected to said drive force transmission part for supplying the drive force to said drive force transmission part; and an urging member arranged to urge said print head support part in a predetermined direction, said urging member including an elastic member.

15. A printing apparatus comprising:

a print head for ejecting a liquid in order to perform a printing operation of printing on a recording surface of a printing medium, a print head support part for supporting said print head;

a screw shaft member provided on said print head support part in which a first screw part is formed along a moving direction of said print head support part;

a drive force transmission member having a second screw part engaged with said first screw part of said screw shaft member for transmitting a supplied drive force;

a drive force supply part connected to said drive force transmission member for supplying a drive force; and an urging member for directly or indirectly urging said screw shaft member or said drive force transmission member in a direction, said urging member including an elastic member.

16. A printing apparatus comprising:

a print head for ejecting a liquid in order to perform a printing operation on a recording surface of a printing medium;

a print head support part for supporting said print head;

a first screw shaft member provided on said print head support part in which a first screw part is formed along a moving direction of said print head support part;

a first drive force transmission member having a second screw part engaged with said first screw part of said first screw shaft member for transmitting a supplied drive force to said first screw shaft member;

a second screw shaft member having a third screw part formed along a moving direction of said print head support part;

a second drive force transmission member having a fourth screw part engaged with a third screw part of said second screw shaft member for transmitting a supplied drive force to said second screw shaft member in a same direction as a drive force transmission direction of said first drive force transmission member;

a drive force supply part connected to said first drive force transmission member and said second drive force transmission member for supplying a drive force; and an urging member disposed between said second screw shaft member and said print head support part for urging said first screw shaft member or said first drive force transmission member in a direction, said urging member including an elastic member.

17. The printing apparatus as claimed in claim 14, wherein a plurality of said print heads are arranged from an upstream side to a downstream side in a transportation path of the printing medium.

18. The printing apparatus as claimed in claim 14, wherein said print head has a liquid ejection opening formation surface on which a plurality of liquid ejection openings are formed corresponding to an entire recording surface of said printing medium.

19. The printing apparatus as claimed in claim 14, wherein said print head has an electrothermal converter for heating a liquid for ejecting said liquid from said liquid ejection opening.

* * * * *

UNITED STATES PATENT AND TRADEMARK OFFICE

CERTIFICATE OF CORRECTION

PATENT NO. : 6,502,922 B2
DATED : January 7, 2003
INVENTOR(S) : Junya Kawase et al.

It is certified that error appears in the above-identified patent and that said Letters Patent is hereby corrected as shown below:

Title page,
Item [56], U.S. PATENT DOCUMENTS, "5,372,936 A 12/1994" should read -- 5,373,936 A 12/1994 --.

Column 2,
Line 27, "engaged." should read -- engaged --.

Column 7,
Line 1, "comers" should read -- corners --; and
Line 11, "comers" should read -- corners --.

Column 8,
Line 39, "low-power." should read -- low power. --.

Column 10,
Line 44, "each other," should read -- as each other --.

Column 14,
Line 27, "each other." should read -- as each other --.

Column 15,
Line 20, "constant" should be deleted.

UNITED STATES PATENT AND TRADEMARK OFFICE

CERTIFICATE OF CORRECTION

PATENT NO. : 6,502,922 B2
DATED : January 7, 2003
INVENTOR(S) : Junya Kawase et al.

It is certified that error appears in the above-identified patent and that said Letters Patent is hereby corrected as shown below:

Column 17,
Line 48, “post” should read -- part --; and
Line 61, “medium,” should read -- medium; --.

Signed and Sealed this

Fifteenth Day of July, 2003

JAMES E. ROGAN
*Director of the United States Patent and Trademark Office*